US005109912A

United States Patent [19]

Gary

[11] Patent Number: 5,109,912

[45] Date of Patent: May 5, 1992

[54] DRAPERY SYSTEM

[76] Inventor: Leonard Gary, 219 Avenue H, Redondo Beach, Calif. 90277

[21] Appl. No.: 261,591

[22] Filed: Oct. 24, 1988

[51] Int. Cl.[5] ..... A47H 1/00

[52] U.S. Cl. ..... 160/330; 160/84.1; 160/126

[58] Field of Search ..... 160/345, 346, 123, 126, 160/330, 84.1; 16/87.2, 93 D, 94 D, 95 D, 96 D

[56] References Cited

U.S. PATENT DOCUMENTS

| | | | |
|---|---|---|---|
| 3,196,511 | 7/1965 | Kintner | 160/330 |
| 3,286,299 | 11/1966 | Golden | 160/330 X |
| 3,369,589 | 2/1968 | Benkert | 160/84.1 |
| 3,460,603 | 8/1969 | Toder | 160/345 |
| 3,503,434 | 3/1970 | Ford | 160/345 |
| 3,522,621 | 8/1970 | Ford et al. | 160/345 X |
| 3,632,154 | 1/1972 | Woodrich | 160/330 X |
| 3,777,800 | 11/1973 | Susoev | 160/84.1 |
| 3,996,987 | 12/1976 | Rodriguez | 160/330 X |
| 4,437,505 | 3/1984 | Rodgers | 160/126 |
| 4,747,442 | 5/1988 | Bade | 160/330 X |

*Primary Examiner*—David M. Purol

*Attorney, Agent, or Firm*—Charles T. Silberberg

[57] ABSTRACT

A drapery system which allows for rapid hanging and removal of drapes has carriers which are connected to the drape panels using strips of Velcro material. Velcro material is secured to the drape panels at selected areas, such that when joined to the carriers, which also have a Velcro material secured thereto (of a type which will mate with the Velcro material on the panels), the drapes will hang uniformly from the track. The strips of Velcro material on the drape panels can also be used in one embodiment to control the depth and number of folds in the panels. The panels can optionally have pockets in the heading for the connection of the carriers such that the carriers and material to which they are fastened are hidden on both sides of the drapes.

15 Claims, 1 Drawing Sheet

DRAPERY SYSTEM

FIELD OF THE INVENTION

This invention relates to a drapery system. More particularly, the invention relates to a drapery system which allows for simple, rapid, and safe hanging and removal of drapes.

BACKGROUND OF THE INVENTION

Hanging draperies is typically a slow and difficult process. The standard practice is to hang the draperies from a track using a plurality of "S" shaped pin hooks. The pin hooks are embedded into the drapery panels and are connected respectively to a plurality of carrier members movably mounted in the track. Handling of the pin hooks, which have sharp points, can be physically dangerous and can cause damage to the draperies. It is also difficult to insert the pin hooks into the drapery panels uniformly such that the draperies hang evenly. The pin hooks must be removed when the draperies are removed for cleaning, and then reinserted when the draperies are to again be hung. This is a time consuming process. Damage can also be caused to the draperies, and possibly the track and wall to which they are mounted, by pulling on the draperies (by virtue of the pin hook connection system). Pin hooks can also rust, causing stains to draperies.

A system that has been developed in view of the above problems with the standard drapery hanging system employs snaps on the drapes and on the carriers. While this has resulted in some improvements, it has not seen widespread application. In this regard, the snaps must be affixed to the draperies with exact precision to assure that the draperies hang evenly. This is a difficult and time consuming process which normally requires locating the snap positions on a tape, making the corresponding holes in the tape, riveting the snaps to the tape, and sewing the tape to the draperies. Further, the metal snaps may complicate the cleaning process and do not resolve the problem of the potential damage which may result from pulling on the draperies.

The present invention employs two piece fastening tapes, commercially available under the trade designation of "Velcro." Such tapes, which are readily reuseable, normally include a strip having hooks formed thereon and a strip having loops formed thereon, which loops and hooks may be joined by the application of slight pressure to unite the strips, and which may be separated by a prying movement of the strips to release one from the other. Such fastening tapes are described in U.S. Pat. Nos. 2,717,437; 3,009,235; and 3,114,951.

There are a number of patents that disclose various applications using Velcro fastening tape. These include U.S. Pat. Nos. 3,316,669; 3,391,434; 3,475,810; 4,165,555; and 4,193,152. However, none of these relate to the present invention.

SUMMARY OF THE INVENTION

It is, therefore, an object of the present invention, to provide a drapery system that allows for simple, rapid, and safe hanging and removal of the drapes.

It is another object of the present invention to provide a drapery system that will work to assure that the draperies hang evenly.

It is yet another object of the present invention to provide a drapery system that will mimimize the possibilities for damage by pulling on the drapes.

It is still another object of the present invention to provide a drapery system that will hide the carriers on both sides of the draperies.

Briefly, in accordance with the invention there is provided a drapery system that comprises a plurality of novel drapery carrier members, a novel drapery panel, and a track housing. Each such member comprises a plate and a spool shaped head connected to the plate. A first strip of Velcro fastening tape is secured to the plate. The carrier members are movably connected to the track housing at the head portion. The panel has a plurality of second strips of Velcro fastening tape secured in selected spaces on the rear side of the panel. The second strips are of the type which will mate with the first strips. The second strips are each connected to a respective first strip such that the panel is detachably connected to the carrier members and hangs from the housing.

In one embodiment of the invention, the spaces for the Velcro strips on the panel are selected to control the depth and number of folds in the panel. In another embodiment, the panel employs pockets in which the drapery carrier members are positioned such that the carrier members are hidden on both sides of the draperies. When the panel cord is drawn, the system preferably uses a master carrier which is also detachably connected to the panel by strips of Velcro fastening tape.

Other objects and advantages of the invention will become apparent upon reading the following detailed description and upon reference to the drawings.

While the invention will be described in connection with the preferred embodiments, it will be understood that it is not intended to limit the invention to those embodiments. On the contrary, it is intended to cover all alternatives, modifications, and equivalents which may be included within the spirit and scope of the invention as defined by the appended claims.

DETAILED DESCRIPTION OF THE INVENTION

Figure 1:
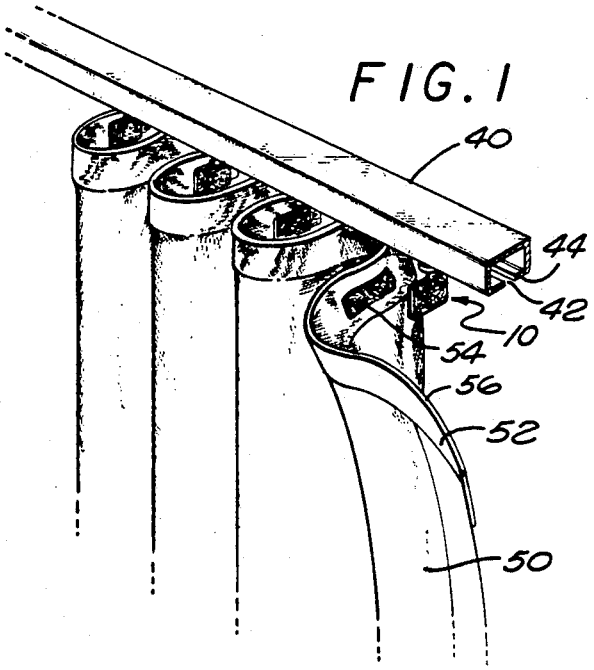
FIG. 1 is a perspective view of a drapery system according to the present invention.
Figure 2:
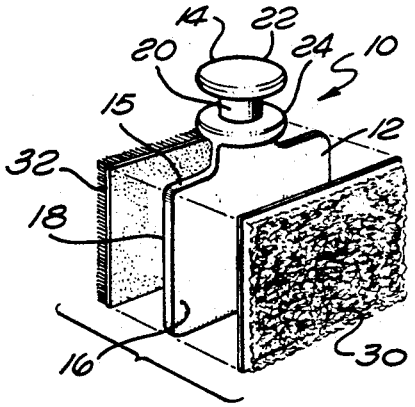
FIG. 2 is an exploded perspective view of a drapery carrier member according to the present invention which can be used in the drapery system of FIG. 1.

Referring now to FIGS. 1 and 2, there is shown a first embodiment of a drapery system according to the present invention, which uses a novel drapery panel and novel drapery carrier members. The system uses a plurality of the drapery carrier members generally indicated at 10. One such drapery carrier member is shown in FIG. 2. Member 10 comprises a flat plate portion 12 and a head portion 14 connected (preferably integrally)

to plate portion 12 along an upper edge 15 of plate portion 12. Plate portion 12 has two principal surfaces 16 and 18. Head portion 14 is spool shaped, having a central rod 20 connected between two cylindrical flanges 22 and 24.

Secured (preferably by adhesive) to principal surface 16 on member 10 is a strip of Velcro fastening tape 30. Strip 30 is shown as the type of Velcro having loops. It could alternately be of the type having hooks, depending on the type to be used on the drapery panel(s) as will be discussed. Another strip of Velcro fastening tape 32 can also be secured to the member 10, this time on surface 18. This strip 32 can be of the other type of Velcro, the hook type as shown, or preferably of the same type as on surface 16—the loop type.

Figure 3:
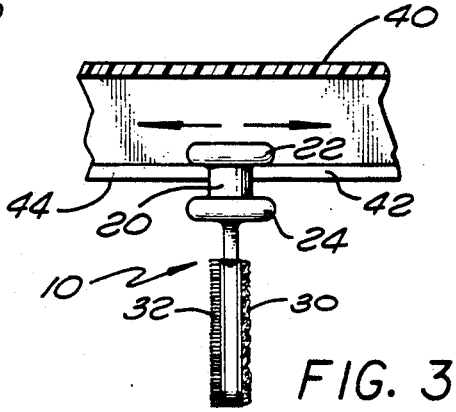
FIG. 3 is a fragmentary elevational view partially in section of a drapery carrier member in the track housing of FIG. 1.

Members 10 are movably connected to a standard drapery track housing 40 as shown in FIGS. 1 and 3. Housing 40 would be connected to a wall (or equivalently a ceiling) not shown. Housing 40 is hollow and has a longitudinal slot 42 running along the bottom side 44 thereof. Upper flange 22 of members 10 fits within housing 40 with the rod 20 passing through the slot 42. With flanges 22 and 24 acting as stops which retain the members 10 in housing 40, the members 10 are free to slide longitudinally within the housing 40. Members 10 are also free to rotate until connected to drapery panel 50.

Drapery panel 50 is flat and not pleated. Panel 50 is shown as having a heading (a hem at the upper edge of the panel) 52 which may be stitched to the rear side of panel 50. The panel may be of any suitable drapery material and is of a size and shape to cover a selected area. Two of such panels could also be used, such as where there are two panels to cover the selected area which close by being moved toward each other.

A plurality of strips 54 of Velcro fastening tape are secured at selected locations on the rear side of the panel 50 along the width of the panel 50 adjacent its upper edge. The number/spacing of the strips 54 will determine (along with the width of the panel relative to the space to be covered) the depth (when stacked back) and number of folds. In this regard, the strips 54 mate with strips 30 on respective carrier members 10. In this case the strips 54 would be of the hook type. Alternately strips 54 could be of the loop type and mate with strips 32. This makes members 10 flexible in that they can be used with either type of Velcro fastening tape strips on panel 50. If strips 30 and 32 are of the same type, then strips 54 must be of the mating type. However, either side of the members 10 can then be used for the connection to the panel 50. By virtue of the connections to carrier members 10, folds are created in between the connections with the maximum depth occurring in the stackback position. One advantage of Velcro is that the strips 54 can be long enough to allow some flexibility in positioning of the mating strips 30 or 32. Thus, if a Velcro strip 34 has not been secured to the panel 50 in exactly the proper location, adjustment is possible by the positioning of strip 30 relative to its corresponding strip 54. Positioning of the strips 54 relative to the upper edge 56 of panel 50, i.e., the distance therefrom, determines the spacing of the upper edge 56 of panel 50 from the bottom of housing 40. In this regard, it is normally preferred that this space be minimized so that carrier members 10 are obscured, which presents a more attractive arrangement.

Figure 4:
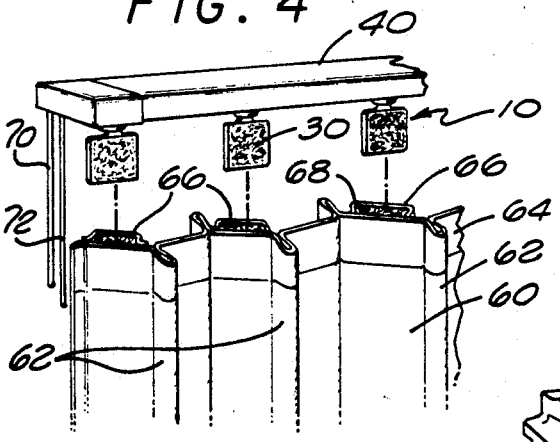
FIG. 4 is a perspective view of another drapery system according to the present invention.

FIG. 4 illustrates another embodiment of the invention. Panel 60 has pleats 62. The heading 64 is generally secured to the rear of panel 60 across the width thereof at the upper edge. However, the heading 64 is not secured at selected portions between pleats 62 such that a plurality of pockets 66 are formed. Strips of Velcro fastening tape 68 are secured inside the pockets 66, either to the heading 64 or the panel 60 (or to both). Carrier members 10 are respectively positioned inside pockets 66 with the Velcro strips 30 of members 10 connecting with strips 68. Pockets 66 are preferably deep enough to completely fit the portions of members 10 protruding from housing 40. Thus, the carrier members 10 are obscured, from both sides of drapery panel 60. It should be understood that pockets 66 are optional—the heading 64 could be completely secured with strips 68 secured to the rear of panel 60 (where the pockets would otherwise be) as in the manner that strips 54 are secured to panel 50.

FIG. 4 also illustrates (in part) the standard drapery pulley system. Pulling on cord portion 70 will draw the drapery panel in one direction while pulling on cord portion 72 will draw the panel in the other direction. In this regard, the cord is connected to one or more master carrier members (such as 80 and 82 of FIG. 5), which are free to slide longitudinally in housing 40.

Figure 6:
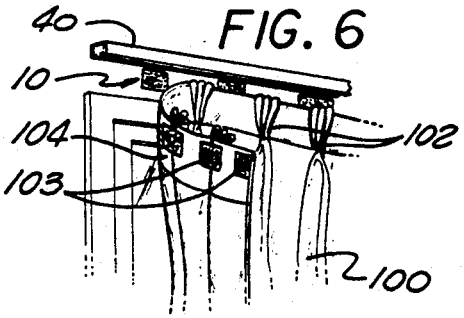
FIG. 6 is a perspective view of yet another drapery system according to the present invention.

FIG. 6 illustrates a panel 100 according to the present invention which has pinch pleats 102 (also known as French pleats). In this embodiment the strips of Velcro fastening tape 103 are secured on heading 104 directly behind (in corresponding alignment with) the pleats 102.

Figure 5:
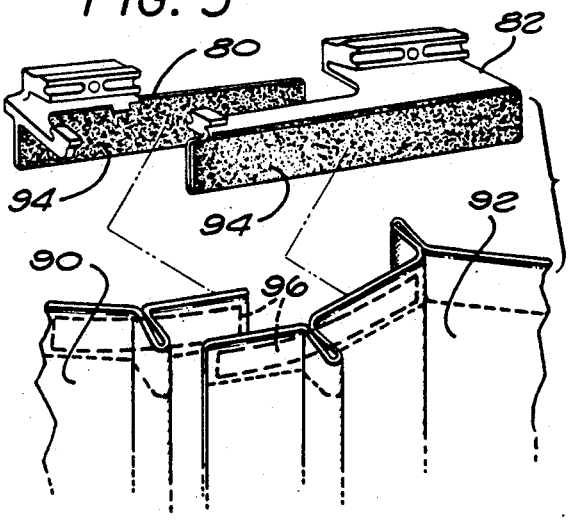
FIG. 5 is a exploded perspective view illustrating the use of master carriers in the drapery system of the present invention.

Referring now to FIG. 5, there is shown master carriers 80 and 82, of the overlap type. Other types of master carriers could also be used, such as the butt type. In the present case, pulling one of the pulley cord portions will draw the panels 90 and 92 in opposite directions—either together or apart. Master carrier members 80 and 82 are also connected to panels 90 and 92 using strips of Velcro fastening tape, designated 94 which mate to respective strips 96 (shown by broken line) on the rear side of panels 90 and 92. Strips 96 which are to be connected to strips 94 are positioned on panels 90 and 92 specifically to properly mate with the strips 94.

In view of the above, it should be understood that the detachable Velcro connections of the carriers to the panel(s) of the present invention allows for rapid, safe, and simple hanging and removal of draperies. Further, the positioning of the Velcro strips on the drapery panel serves to position the panel evenly. There is also less risk of damage due to pulling on the drapes, i.e., the panel is more likely to be disconnected from the carrier members rather than torn or the housing removed.

Thus, it is appparent that there has been provided, in accordance with the invention, a drapery system that fully satisfies the objectives, aims, and advantages set forth above. While the invention has been described in connection with specific embodiments thereof, it is evident that many alternatives, modifications, and variations will be apparent to those skilled in the art in light of the forgoing description. Accordingly, it is intended to embrace all such alternatives, modifications, and variations which will fall within the spirit of the appended claims.

I claim:

1. A drapery carrier member comprising:

a plate, said plate having two principal surfaces, a respective strip of Velcro fastening tape secured to each of said principle surfaces; and a spool shaped head, said head having a central rod connected to a flange at each of its opposite ends, said head being connected to an edge of said plate at one of said flanges.

2. The drapery carrier member of claim 1 wherein on one of said principal surfaces the Velcro fastening tape is of the hook type while on the other principal surface the Velcro fastening tape is of the loop type.

3. A drapery panel comprising:

a cloth in a shape and size to cover a selected area, said cloth having an upper edge along the width of said cloth, said cloth having a heading secured on the rear side of said cloth running along the width of said cloth adjacent the upper edge of said cloth, said heading being unsecured at selected areas thereof such that a plurality of pockets are defined, said pockets having an opening at the upper edge of said cloth, said pockets being positioned at preselected areas between said pleats; and a plurality of strips of Velcro fastening tape, at least one of said strips being secured in each of said pockets.

4. A drapery panel comprising:

a cloth in a shape and size to cover a selected area, said cloth having an upper edge along the width of said cloth, said cloth having a plurality of joined pleats; and a plurality of strips of Velcro fastening tape, said strips secured to said cloth in selected spaces on the rear side of said cloth along the width of said cloth adjacent the upper edge of said cloth, said spaces being between said pleats.

5. A drapery panel comprising:

a cloth in a shape and size to cover a selected area, said cloth having an upper edge along the width of said cloth, said cloth having a plurality of joined pleats; and a plurality of strips of Velcro fastening tape, said strips secured to said cloth in selected spaces on the rear side of said cloth along the width of said cloth adjacent the upper edge of said cloth, said spaces being in corresponding alignment with said pleats.

6. A drapery system comprising:

a hollow track housing, said housing having a longitudinal slot in the bottom surface thereof;

a plurality of drapery carrier members, each of said members having a plate and a spool shaped head, said plate having two principal surfaces, a first strip of Velcro fastening tape secured to each of said principal surfaces, said head having a central rod connected to a flange at each of its opposite ends, said head being connected to an edge of said plate at one of said flanges, said members connected to said housing through said slot such that said other flange of said members is within said housing and said rod of said members extends through said slot, whereby said plates of said members project downwardly from said housing; and a drapery panel in a shape and size to cover a selected area, said panel having an upper edge along the width of said panel, said panel having a plurality of second strips of Velcro fastening tape secured to said panel in selected spaces on the rear side of said panel along the width of said panel adjacent the upper edge of said panel, said second strips being of the type that will mate with said first strips, said second strips each being connected to a respective first strip such that said panel is detachably connected to said members and hangs from said housing.

7. The drapery system of claim 6 wherein on one of said principal surfaces of each of said drapery carrier members the Velcro fastening tape is of the hook type while on the other principal surface the Velcro fastening tape is of the loop type.

8. The drapery system of claim 6 wherein said spaces are selected to control the depth and number of folds in said panel.

9. The drapery system of claim 6 wherein said panel has a plurality of joined pleats, and said spaces are between said pleats.

10. The drapery system of claim 6 wherein there are two panels.

11. The drapery system of claim 6 wherein said second strips are positioned relative to the upper edge of said panel such that connection of said drapery carrier members to said panel positions the upper edge of said panel adjacent said housing.

12. The drapery system of claim 6 also including:

a master carrier mounted to said housing for movement along said slot, said master carrier having a plate portion projecting downwardly from said housing, said plate portion also having a first strip of Velcro fastening tape secured to said plate portion, said first strip on said plate portion being connected to a second strip on said panel such that said panel is detachably connected to master carrier; and a pulley means connected to said master carrier to selectively cause movement of said master carrier within said housing such that said panel covers all or a portion of said selected area.

13. The drapery system of claim 6 wherein said housing is secured to a wall and the length of said panel is substantially equal to the distance from the bottom of the housing to the bottom of the wall.

14. The drapery system of claim 6 wherein said panel has a plurality of joined pleats, and said spaces are in corresponding alignment with said pleats.

15. The drapery system of claim 9 wherein said panel has a heading secured on the rear side of said panel running along the width of said panel adjacent the upper edge of said panel, said heading being unsecured at selected areas thereof such that a plurality of pockets are defined, said pockets having an opening at the upper edge of said panel, said pockets being positioned at preselected areas between said pleats, said spaces being within said pockets such that said second strips are secured within said pockets and said drapery carrier members are positioned in said pockets.

* * * * *